US008806677B1

(12) United States Patent
Bartelsmeyer et al.

(10) Patent No.: US 8,806,677 B1
(45) Date of Patent: Aug. 19, 2014

(54) PEDESTAL BED BASE

(71) Applicant: L&P Property Management Company, South Gate, CA (US)

(72) Inventors: Robert A. Bartelsmeyer, High Point, NC (US); Joy Fozard, Thomasville, NC (US); David W. Stroud, Lexington, NC (US)

(73) Assignee: L&P Property Management Company, South Gate, CA (US)

( * ) Notice: Subject to any disclaimer, the term of this patent is extended or adjusted under 35 U.S.C. 154(b) by 19 days.

(21) Appl. No.: 13/751,571

(22) Filed: Jan. 28, 2013

(51) Int. Cl.
*A47C 27/20* (2006.01)
*A47C 19/00* (2006.01)

(52) U.S. Cl.
CPC ..... *A47C 19/005* (2013.01)
USPC ..... 5/400; 5/200.1; 5/282.1; 5/201

(58) Field of Classification Search
USPC ..... 5/400, 200.1, 282.1, 286, 131, 285, 5/288, 292, 299, 304
See application file for complete search history.

(56) References Cited

U.S. PATENT DOCUMENTS

| | | | |
|---|---|---|---|
| 4,554,692 | A | 11/1985 | Whitehead |
| 6,925,666 | B2 | 8/2005 | Harrow |
| 7,437,783 | B2 | 10/2008 | Navarro et al. |
| 7,865,981 | B2 | 1/2011 | Harrow |

*Primary Examiner* — Brittany Wilson
(74) *Attorney, Agent, or Firm* — Wood, Herron & Evans, LLP

(57) ABSTRACT

A pedestal bed base uses four corner assemblies to connect side and end members without the need for fasteners or tools. Each corner assembly comprises only two plastic pieces which may be secured to the side and end members of the pedestal bed base frame in a snap-fit manner and secured to each other. The corner assemblies enable a person to assemble the pedestal bed base quicker and less expensively than if such assembler had to use tools.

18 Claims, 9 Drawing Sheets

PEDESTAL BED BASE

TECHNICAL FIELD

The present invention relates generally to pedestal bed bases for use in supporting bedding products.

BACKGROUND

Pedestal bed bases are commonly used structures to support a box spring and mattress above the floor. Typically, pedestal bed bases are made up of a number of pieces that are shipped unassembled and then installed at a location where the bed base is to be used. Such pedestal bed bases are commonly installed in hotels or motels.

Prior art pedestal bed bases have required the use of tools to assemble. When installing a large number of bed bases the use of tools to put together the bed base slows the installation process. The use of fasteners and tools increases the cost of installation of the bed bases and the shipping costs. Ideally, the fewer number of parts required to assemble a bed base, the easier and less costly the installation.

Thus, a need exists in the art for a pedestal bed base having a minimum number of parts that may be assembled quickly and without the use of tools.

SUMMARY OF THE INVENTION

According to one embodiment of the invention, a pedestal bed base comprises two side members and two end members joined together with four corner assemblies. Each of the corner assemblies is made of plastic and connects one of the side members and one of the end members. Furthermore, each of the corner assemblies comprises an upper piece and a lower piece snap-fit together without the use of any tools or fasteners in a quick, easy and inexpensive manner. At least one of the pieces of the corner assembly is secured in a snap-fit manner to one of the side members and one of the end members of the bed base.

According to another aspect of the invention, a pedestal bed base comprises two side members and two end members joined together with four corner assemblies. Each of the corner assemblies is made of plastic and connects one of the side members and one of the end members. Each of the corner assemblies comprises an upper piece and a lower piece secured together in a snap-fit manner without a need for any tools or fasteners. A portion of one of the side members and a portion of one of the end members of the bed base are sandwiched between the upper and lower pieces of the corner assembly.

According to another aspect of the invention, a method of assembling a pedestal bed base comprises multiple steps. One step comprises snapping one of two side members of the pedestal bed base into engagement with an upper piece of a corner assembly. Another step comprises snapping one of two end members of the pedestal bed base into engagement with the upper piece of the corner assembly. Another step comprises snapping a lower piece of the corner assembly into engagement with the upper piece of the corner assembly such that a first projection of the lower piece of the corner assembly fits into an opening in one of the side members of the bed base and a second projection of the lower piece of the corner assembly fits into an opening in one of the end members of the bed base.

BRIEF DESCRIPTION OF THE DRAWINGS

The accompanying drawings, which are incorporated in and constitute a part of this specification, illustrate embodiments of the invention and, together with the general description given above and the detailed description of the embodiments given below, serve to explain the principles of the invention. In the figures, corresponding or like numbers or characters indicate corresponding or like structures.

DETAILED DESCRIPTION OF THE ILLUSTRATIVE EMBODIMENTS

Figure 1:
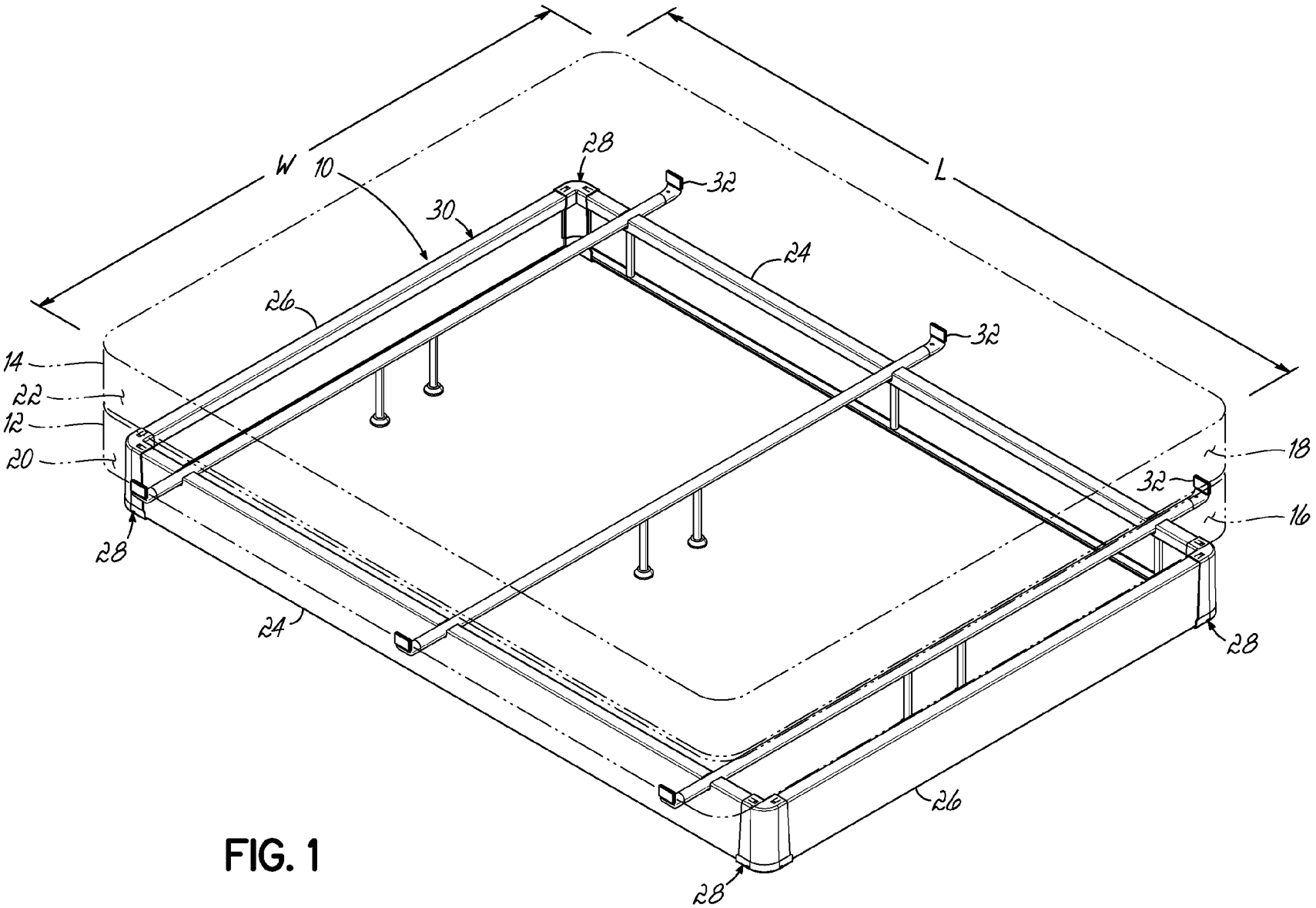
FIG. 1 is an isometric view of an assembled pedestal bed base supporting a box spring and mattress shown in phantom.

Referring to FIG. 1, there is illustrated an assembled pedestal bed base 10 supporting a box spring 12 and mattress 14. The present invention is not intended to limit the box spring 12 or mattress 14 which may be used with the pedestal bed base 10 of the present invention. The box spring 12 and mattress 14 each has a longitudinal dimension or length "L" extending between end surfaces 16, 18, respectively of the box spring 12 and mattress 14 (only one being shown) and a transverse dimension or width "W" extending between the side surfaces 20, 22, respectively, of the box spring 12 and mattress 14 (only one being shown). Although the length is shown as being greater than the width, the length and width may be the same in the case of a square box spring and mattress. The present invention is not intended to limit the size, type or shape of the box spring 12 or mattress 14.

Figure 3:
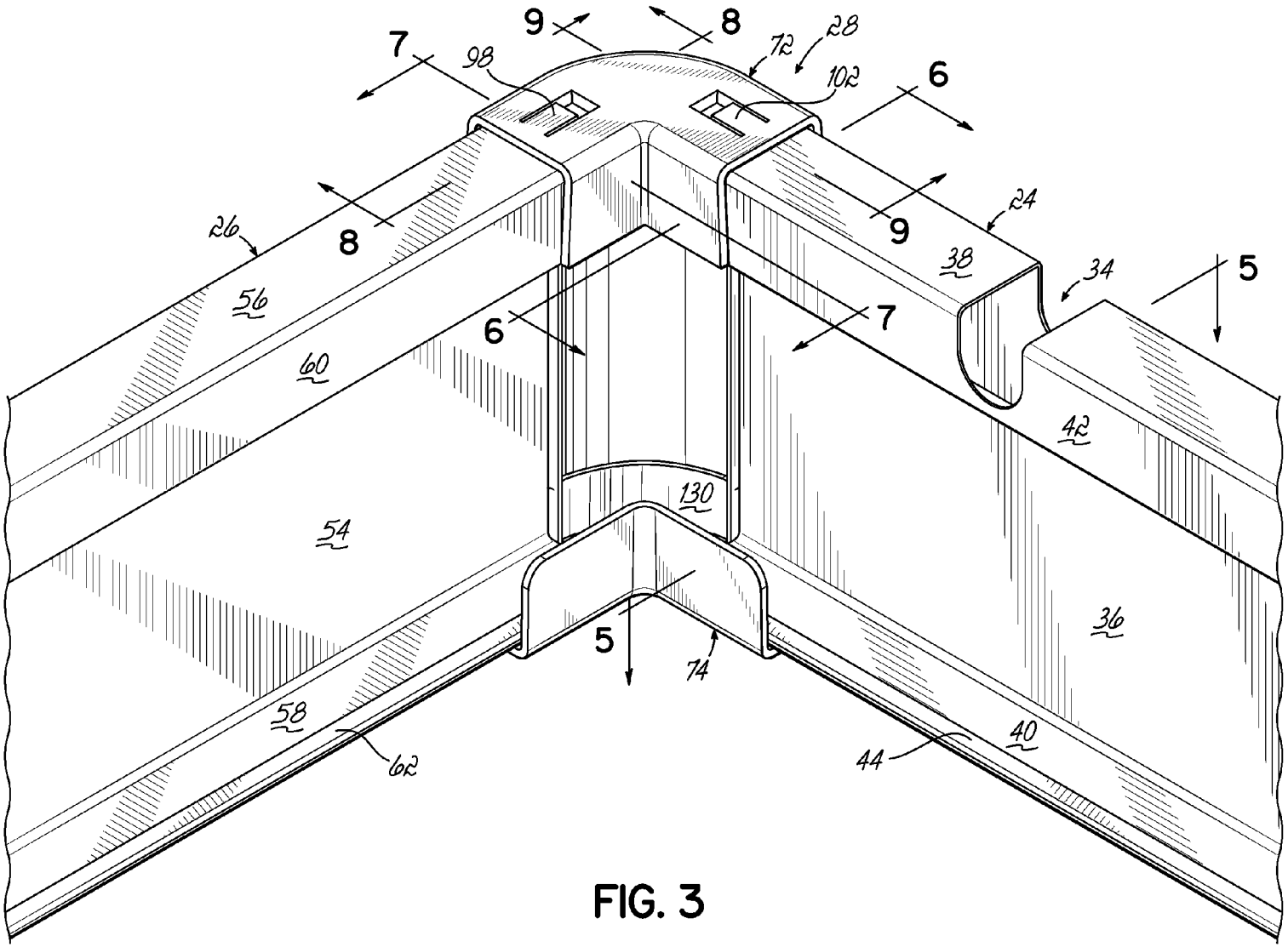
FIG. 3 is an enlarged perspective view of a corner of the bed base of FIG. 1.

Referring to FIG. 1, the pedestal bed base 10 comprises two side members 24 and two end members 26 joined together with four corner assemblies 28 to complete a generally rectangular base 30. Three spaced cross rail assemblies 32, each extending transversely, are supported by the base 30 and are positioned across the side members 24. Each of the cross rail assemblies 32 extends outside the base 30 and is sized for a particular size box spring 12 and mattress 14. As shown in FIG. 3, each of the cross rail assemblies 32 fits inside aligned recesses 34 in the side members 24 (only one being shown). Although one type of cross rail assembly 32 is illustrated, any other type of cross rail assembly may be used. The present invention is not intended to limit the size, type or shape of the cross rail assemblies 32.

Figure 4:
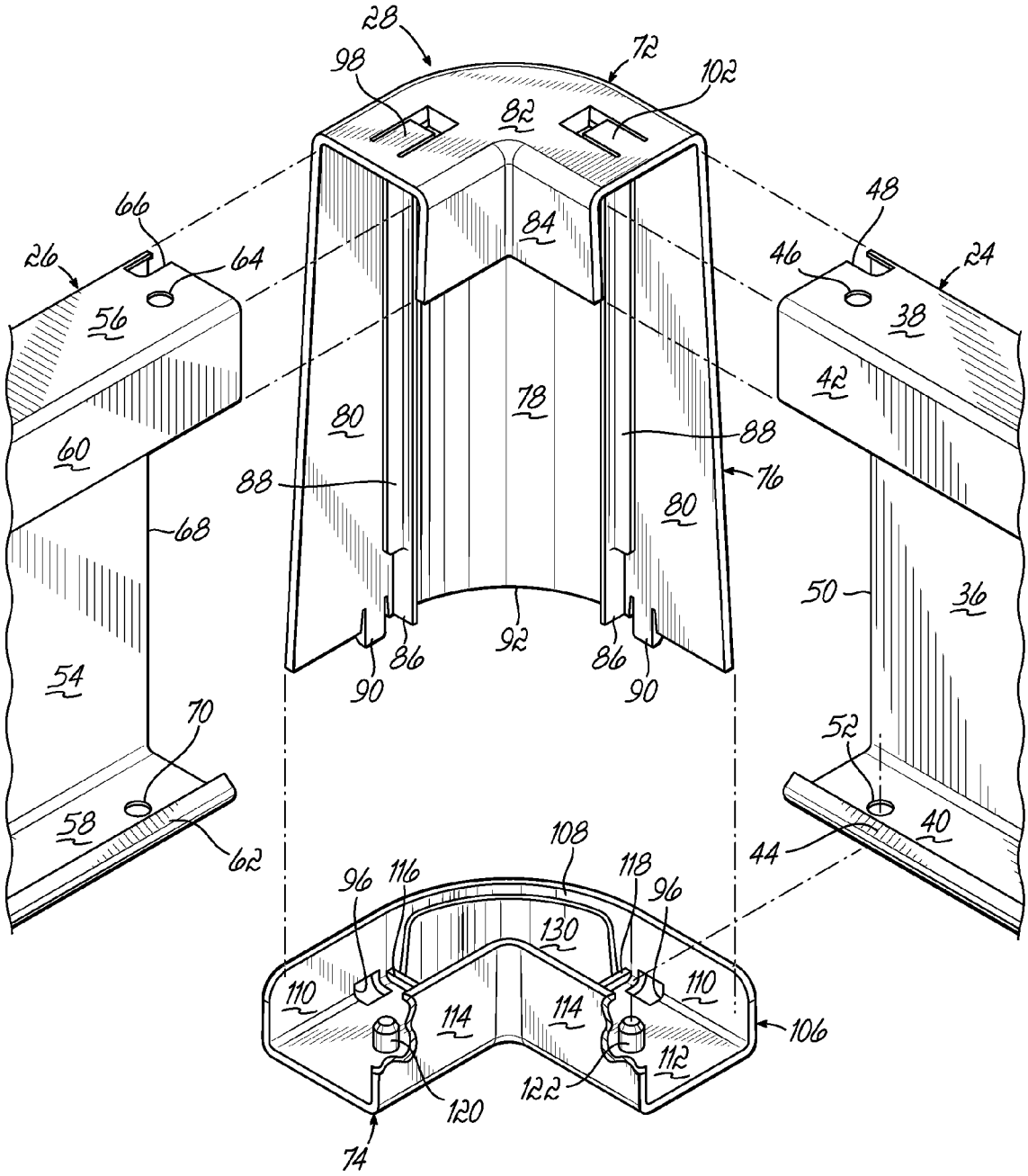
FIG. 4 is a partial disassembled perspective view of a corner of the bed base of FIG. 1, showing the two pieces of a corner assembly.
Figure 6:
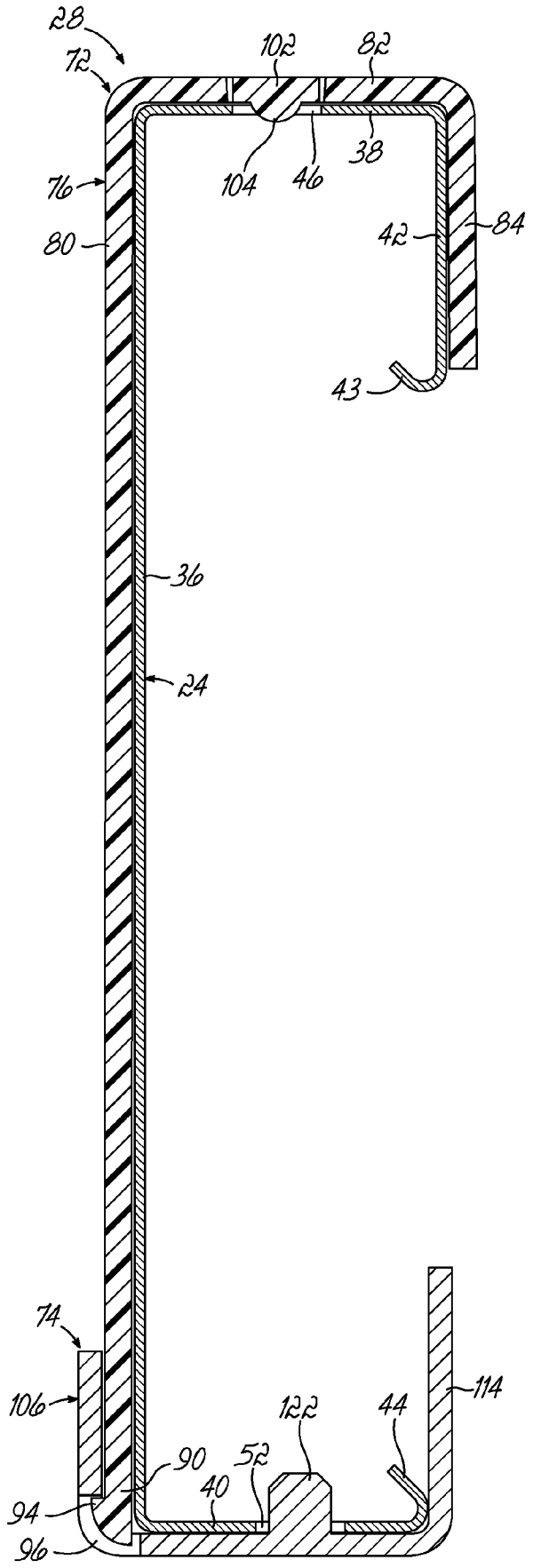
FIG. 6 is a cross-sectional view taken along line 6-6 of FIG. 3.

As best shown in FIGS. 4 and 6, each of the side members 24 of the generally rectangular base 30 is commonly made of sheet metal and formed using conventional stamping and bending techniques including roll forming. Each of the side members 24 comprises a vertically oriented side wall portion 36, a horizontally oriented upper wall portion 38 and a horizontally oriented lower wall portion 40, the upper and lower wall portions 38, 40, respectively, each extending inwardly from the side wall portion 36. The side member 24 also has an inner wall portion 42 extending downwardly from the upper wall portion 38. As best shown in FIG. 6, inner wall portion 42 has an upwardly and inwardly directed flange 43. Similarly, lower wall portion 40 has an upwardly and inwardly directed flange 44. The upper wall portion 38 has an opening 46 therethrough and a notch or cutout 48 extending inwardly from an outer edge 50 of the side member 24. The lower wall portion 40 has an opening 52 therethrough. Although the openings 46, 52 in the upper and lower wall portions 38, 40, respectively, are shown as being circular, they may be other shapes, such as oval or rectangular, if desired.

Figure 7:
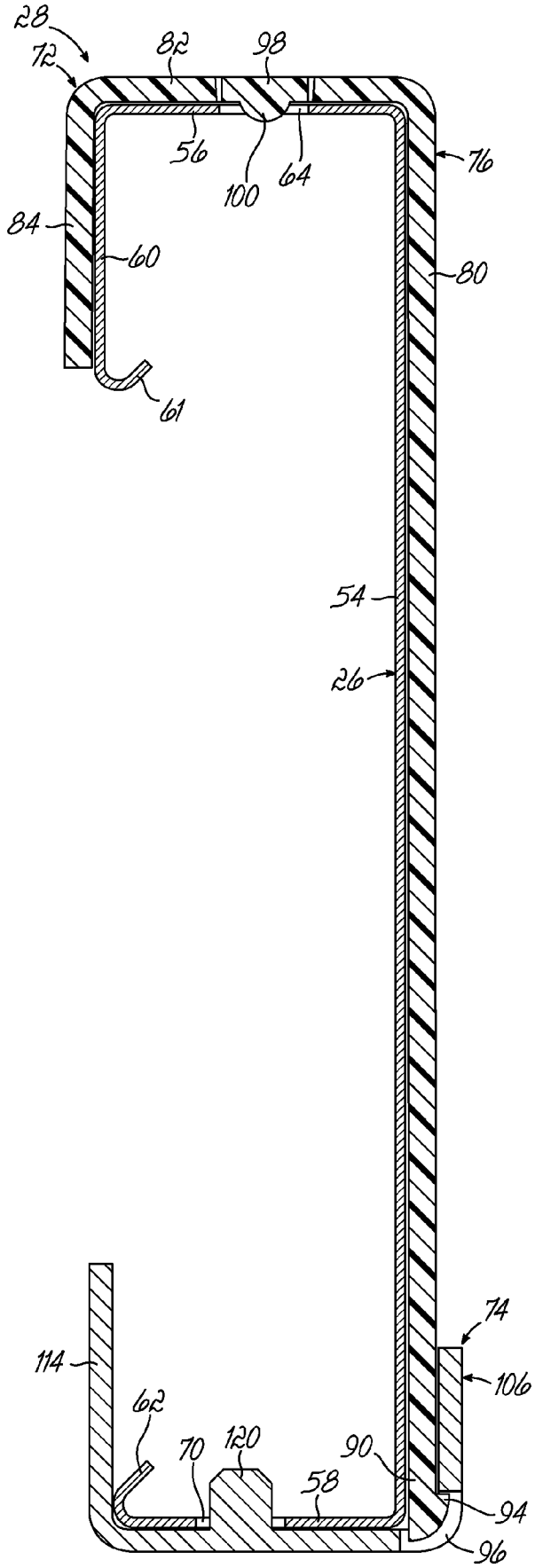
FIG. 7 is a cross-sectional view taken along line 7-7 of FIG. 3.

Similarly, as best shown in FIGS. 4 and 7, each of the end members 26 of the generally rectangular base 30 is commonly made of sheet metal and formed using conventional stamping and bending techniques including roll forming. As shown in FIG. 4, each of the end members 26 comprises a vertically oriented side wall portion 54, a horizontally oriented upper wall portion 56 and a horizontally oriented lower wall portion 58, the upper and lower wall portions 56, 58, respectively, each extending inwardly from the side wall portion 54. The end member 26 also has an inner wall portion 60 extending downwardly from the upper wall portion 56. As shown in FIG. 7, inner wall portion 60 has an upwardly and inwardly extending flange 61. Similarly, lower wall portion 58 has an upwardly and inwardly extending flange 62. The upper wall portion 56 has an opening 64 therethrough and a notch or cutout 66 extending inwardly from an outer edge 68 of the end member 26. The lower wall portion 58 has an opening 70 therethrough. Although the openings 64, 70 in the upper and lower wall portions 56, 58, respectively, are shown as being circular, they may be other shapes, such as oval or rectangular, if desired.

As best shown in FIG. 1, the pedestal bed base 10 comprises four corner assemblies 28, one of which is shown in disassembled form in FIG. 4. Each corner assembly 28 comprises two pieces: an upper piece 72 and a lower piece 74 which snap together without the use of any tools or fasteners. Because no tools or fasteners are required, the corner assembly may be assembled and joined to the side and end members 24, 26 of the pedestal bed base 10 quickly and easily without much cost. Although the upper and lower pieces 72, 74 of each corner assembly 28 are preferably made of plastic, they may be made of other materials.

As best shown in FIG. 4, the upper piece 72 of each corner assembly 28 comprises a unitary piece, including an outer wall portion 76 having an arcuate middle portion 78 and two generally flat, generally planar portions 80 on opposite sides of the arcuate middle portion 78. The upper piece 72 of the corner assembly 28 further comprises a top wall portion 82 extending inwardly from the outer wall portion 76 and an inner wall portion 84 extending downwardly from the top wall portion 82. The inner wall portion 84 has two portions at right angles to each other, as shown in FIG. 4. Each of these portions of the inner wall portion 84 is generally parallel and spaced inwardly from one of the generally planar portions 80 of the outer wall portion 76. The upper piece 72 of the corner assembly 28 further comprises two stops 86 extending inwardly from the outer wall portion 76, each stop 86 extending generally perpendicular to the outer wall portion 76. Each stop 86 has a stop extension 88 extending generally perpendicular to the stop 86 and being generally parallel to one of the generally planar portions 80 of the outer wall portion 76.

When a corner of the generally rectangular base 30 is assembled as shown in FIG. 3, the side wall portion 54 of the end member 26 is located between one of the stop extensions 88 and its corresponding generally planar portion 80 of the upper piece 72 of the corner assembly 28 to prevent lateral movement of the end member 26 and stabilize the generally rectangular base 30. Similarly, the side wall portion 36 of the side member 24 is located between the other stop extension 88 and its corresponding generally planar portion 80 of the upper piece 72 of the corner assembly 28 to prevent lateral movement of the side member 24 and stabilize the generally rectangular base 30.

In order to aid in snapping together the upper and lower pieces 72, 74 of the corner assembly 28, the outer wall portion 76 of the upper piece 72 of the corner assembly 28 has two leg portions 90 extending downwardly beyond a lower edge 92 of the outer wall portion 76 of the upper piece 72 of the corner assembly 28. As shown in FIGS. 6 and 7, each leg portion 90 has a catch 94 at the bottom thereof to engage an opening 96 in the lower piece 74 of the corner assembly 28.

Figure 8:
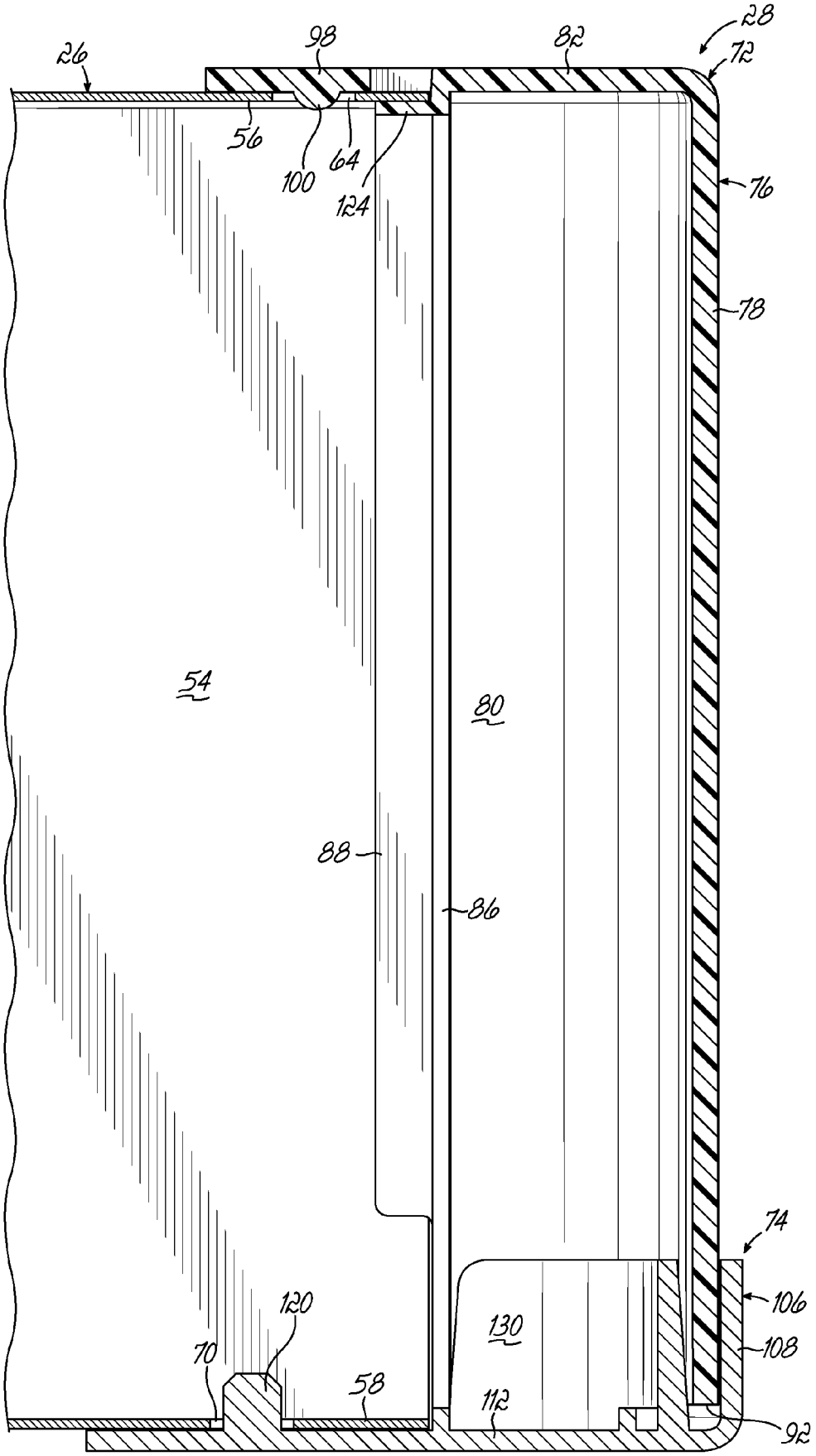
FIG. 8 is a cross-sectional view taken along line 8-8 of FIG. 3.

In order to aid in securing the upper piece 72 of the corner assembly 28 to one of the end members or pieces 26 of the generally rectangular base 30, the top wall portion 82 of the upper piece 72 of the corner assembly 28 has a first flexible tab 98 which has a button 100. See FIG. 7. As shown in FIG. 7, when the corner assembly 28 is secured to the end member 26 of the generally rectangular base 30, the button 100 extends downwardly into the opening 64 in the upper wall portion 56 of the end member 26. As shown in FIG. 7, the first flexible tab 98 of the upper piece 72 of each corner assembly 28 engages an opening 64 in the upper wall portion 56 of one of the end members 26 and locks together the corner assembly 28 and end member 26 of generally rectangular base 30 in a snap-fit manner without the need for any fasteners or tools. As shown in FIG. 8, the upper piece 72 of the corner assembly 28 has a first fixed extension 124 stepped down from the top wall portion 82 which provides a floor for the upper wall portion 56 of the end member 26 so that when assembled the upper wall portion 56 of the end member 26 is trapped between the first fixed extension 124 and the flexible tab 98 of the upper piece 72 of the corner assembly 28 for increased stability of the end member 26.

Figure 9:
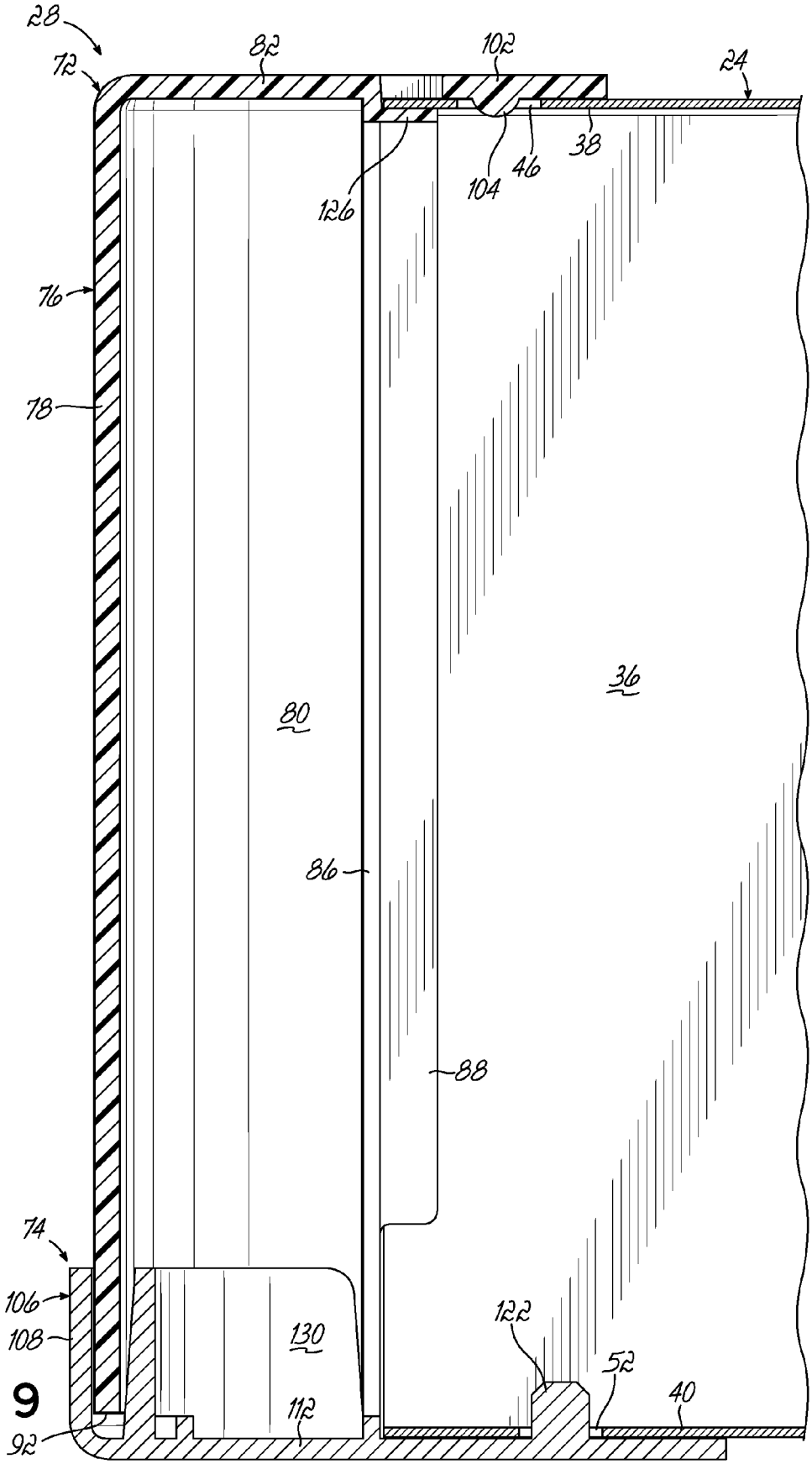
FIG. 9 is a cross-sectional view taken along line 9-9 of FIG. 3.

Similarly, in order to aid in securing the upper piece 72 of the corner assembly 28 to one of the side members or pieces 24 of the generally rectangular base 30, the top wall portion 82 of the upper piece 72 of the corner assembly 28 has a second flexible tab 102 which has a button 104. See FIG. 6. As shown in FIG. 6, when the corner assembly 28 is secured to the side member 24 of the generally rectangular base 30, the button 104 extends downwardly into the opening 46 in the upper wall portion 38 of the side member 24. As shown in FIG. 6, the second flexible tab 102 of the upper piece 72 of each corner assembly 28 engages an opening 46 in the upper wall portion 38 of one of the side members 24 and locks together the corner assembly 28 and side member 24 of generally rectangular base 30 in a snap-fit manner without the need for any fasteners or tools. As shown in FIG. 9, the upper piece 72 of the corner assembly 28 has a second fixed extension 126 stepped down from the top wall portion 82 which provides a floor for the upper wall portion 38 of the side member 24 so that when assembled the upper wall portion 38 of the side member 24 is trapped between the second fixed extension 126 and the flexible tab 102 of the upper piece 72 of the corner assembly 28 for increased stability of the side member 24.

As best shown in FIG. 4, the lower piece 74 of each corner assembly 28 comprises a unitary piece, including an outer wall portion 106 having an arcuate middle portion 108 and two generally flat, generally planar portions 110 on opposite sides of the arcuate middle portion 108. The lower piece 74 of the corner assembly 28 further comprises a floor portion 112 extending inwardly from the outer wall portion 106 and an inner wall portion 114 extending upwardly from the floor portion 112. The inner wall portion 114 has two portions at right angles to each other, as shown in FIG. 4. Each of these portions of the inner wall portion 114 is generally parallel and spaced inwardly from one of the generally planar portions 110 of the outer wall portion 106. The lower piece 74 of the corner assembly 28 further comprises first and second ribs 116, 118 extending upwardly from the floor portion 112, each rib 116, 118 extending generally perpendicular to the outer wall portions 110. The lower piece 74 of the corner assembly 28 further comprises a first projection 120 and a second projection 122 each extending upwardly from the floor portion 112 of the lower piece 74 of corner assembly 28. Although the first and second projections 120, 122, respectively, are shown as being generally cylindrical, they may be other shapes or sizes, if desired, as long as they fit inside the openings 52, 70, respectively. The lower piece 74 of the corner assembly 28 further comprises an interior stop 130 extending upwardly from the floor portion 112 and extending between the ribs 116, 118 and spaced inwardly from the outer wall portion 106. This interior stop 130 is shown in FIGS. 2, 3, 4, 5, 8 and 9.

Figure 2:
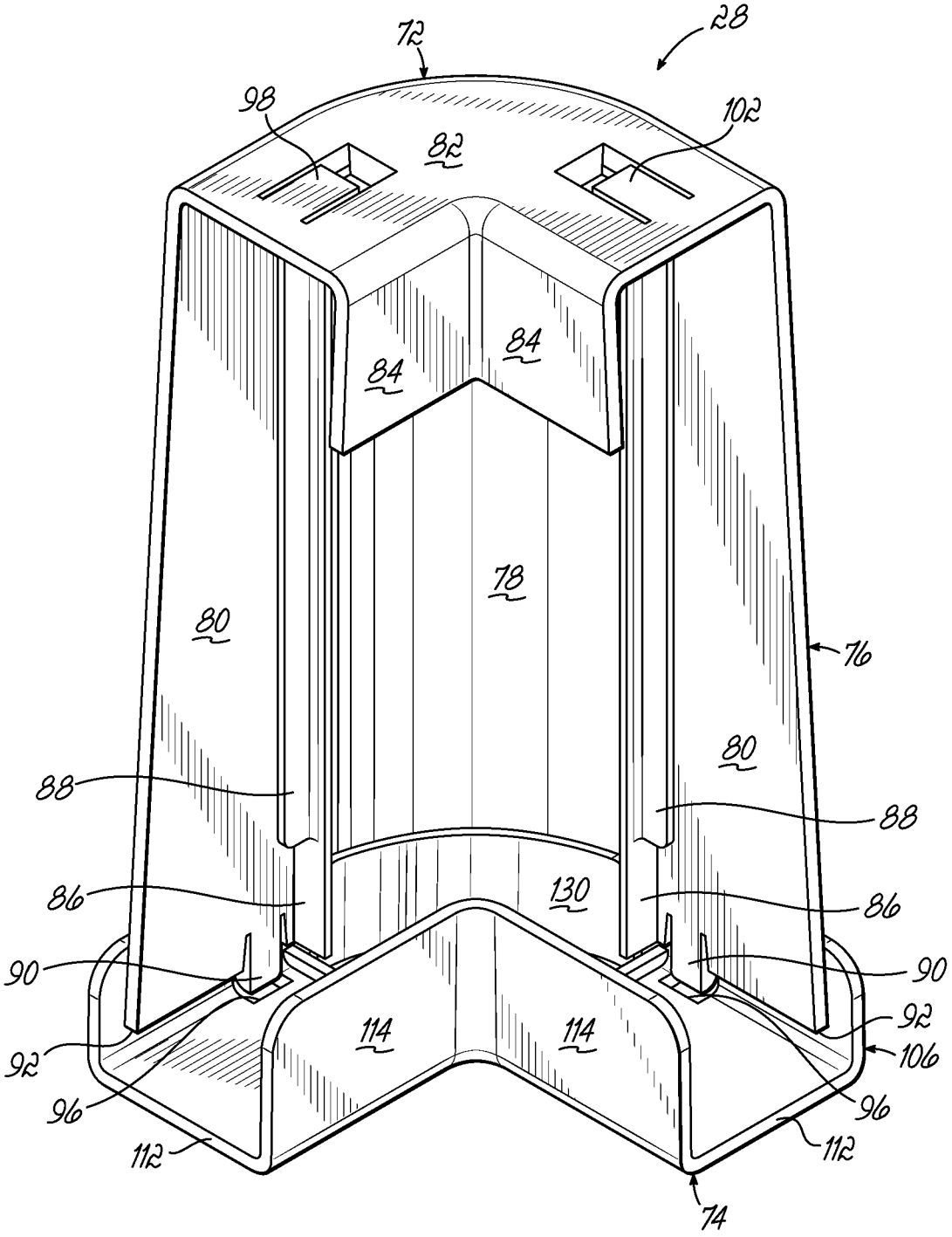
FIG. 2 is an enlarged perspective view of an assembled corner assembly.

FIG. 2 shows a corner assembly 28 in an assembled condition with the upper piece 72 engaged to locked in a snap-fit manner with the lower piece 74, the catches 94 of leg portions 90 of the outer wall portion 76 of the upper piece 72 of the corner assembly 28 being locked underneath the openings 96 in the lower piece 74 of the corner assembly 28 in a snap fit manner. As shown in FIGS. 2 and 3, in its assembled condition, the arcuate middle portion 78 of the outer wall portion 76 of the upper piece 72 of the corner assembly 28 is sandwiched between the interior stop 130 and the outer wall portion 106 of the lower piece 74 of the corner assembly 28.

Figure 5:
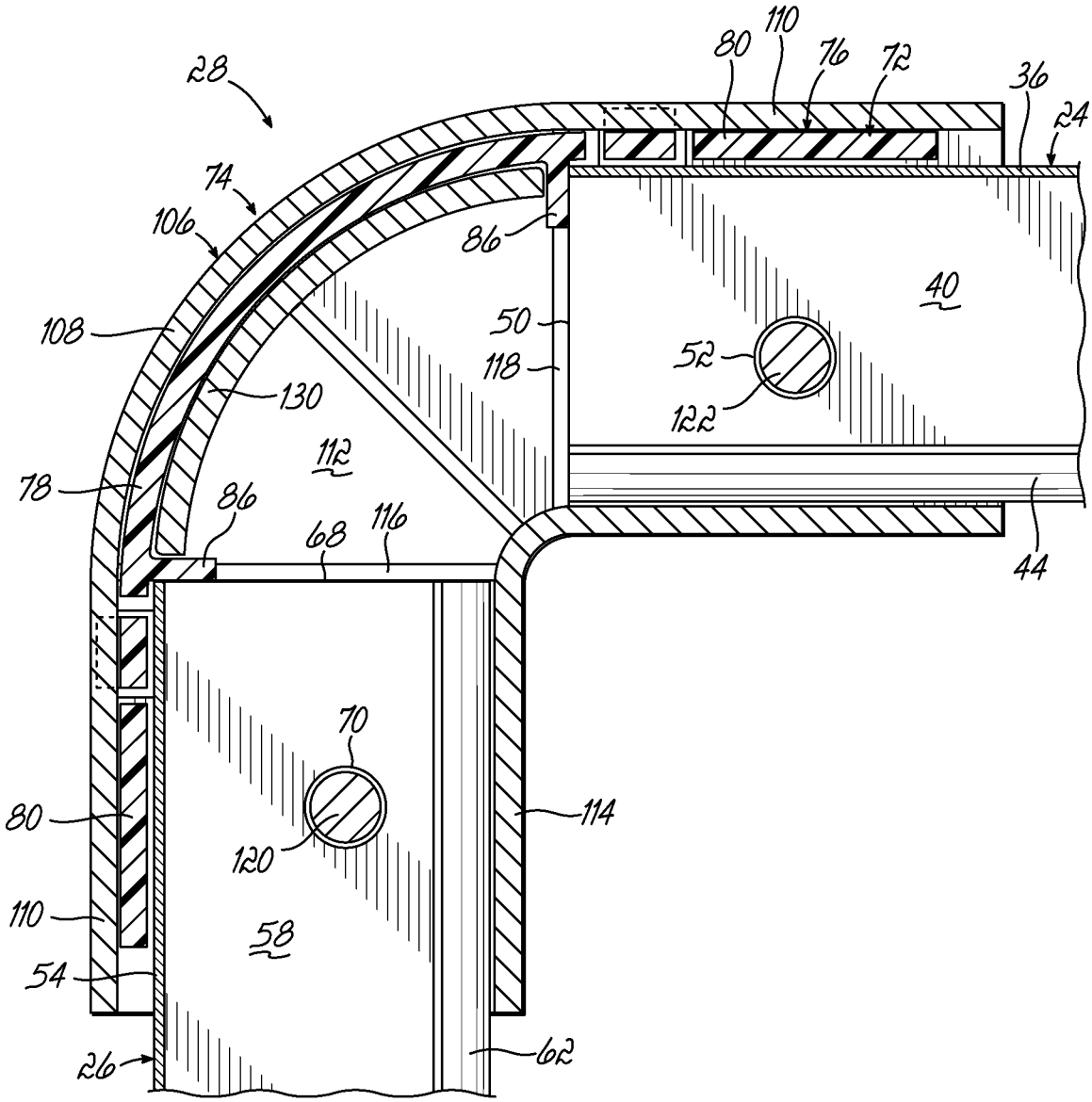
FIG. 5 is a cross-sectional view taken along line 5-5 of FIG. 3.

FIG. 3 shows the corner assembly 28 of FIG. 2 secured to an end member 26 and a side member 24 of the base 30, the corner assembly 28 being in an assembled condition or position. As shown in FIGS. 5, 6 and 7, when the pedestal bed base 10 is assembled, the first projection 120 of the lower piece 74 of the corner assembly 28 is located inside opening 70 in the lower wall portion 58 of the end member 26. Similarly, the second projection 122 of the lower piece 74 of the corner assembly 28 is located inside opening 52 in the lower wall portion 40 of the side member 24.

As best shown in FIG. 5, in an assembled condition, the side edge 68 of the end member 26 abuts or contacts one of the stops 86 of the upper piece 72 of the corner assembly 28, the associated stop extension 88 extending inwardly inside the notch 66 of the end member 26. Similarly, the side edge 50 of the side member 24 abuts against one of the stops 86 of the upper piece 72 of the corner assembly 28, the associated stop extension 88 extending inwardly inside the notch 48 of the side member 24.

As shown in FIGS. 5, 6 and 7, when the pedestal bed base 10 is assembled, the button 100 of the first flexible tab 98 of the upper piece 72 of the corner assembly 28 is located inside opening 64 in the upper wall portion 56 of the end member 26 to secure the corner assembly 28 to the end member 26. Similarly, the button 104 of the second flexible tab 102 of the upper piece 72 of the corner assembly 28 is located inside opening 46 in the upper wall portion 38 of the side member 24 to secure the corner assembly 28 to the side member 24. Lastly, the upper and lower pieces 72, 74 of the corner assembly 28 are secured together by the leg portions 90 of the outer wall portion 76 of the upper piece 72 of the corner assembly 28 extending into the openings 96 in the lower piece 74 of the corner assembly 28 and the catches 94 being underneath the outer wall portion 106 of the lower piece 74 of the corner assembly 28 as shown in FIGS. 6 and 7.

The method of assembling the pedestal bed base 10 comprises supplying two side members 24 and two end members 26 along with four corner assemblies 28. One at a time, a side member 24 and an end member 26 are joined together via a corner assembly 28 without the need for any tools or fasteners. One of the side members 24 is snapped into engagement with the upper piece 72 of the corner assembly 28. Similarly, one of the end members 26 is snapped into engagement with the upper piece 72 of the corner assembly 28 to create a generally "L-shaped" subassembly. The last step in the assembly process is securing the lower piece 74 of the corner assembly 28 to the generally "L-shaped" subassembly. The projections 120, 122 of the lower piece 74 fit inside the openings 70, 52 of the end and side members 26, 24, respectively and the catches 94 at the bottom of the leg portions 90 of the upper piece 72 of the corner assembly 28 engaging openings 96 in the lower piece 74 of the corner assembly 28 to secure the upper and lower pieces 72, 74 of the corner assembly 28 together.

While the invention has been illustrated by the description of embodiments thereof, and while the embodiments have been described in considerable detail, it is not intended to restrict or in any way limit the scope of the appended claims to such detail. Additional advantages and modifications will readily appear to those skilled in the art. Therefore, the invention in its broadest aspects is not limited to the specific details shown and described. The various features disclosed herein may be used in any combination necessary or desired for a particular application. Consequently, departures may be made from the details described herein without departing from the spirit and scope of the claims which follow.

What is claimed is:

1. A pedestal bed base comprising:

two side members;

two end members;

four corner assemblies, each of the corner assemblies connecting one of the side members and one of the end members and comprising an upper piece and a lower piece snap-fit together without the use of any tools or fasteners, at least one of the pieces of the corner assembly being secured in a snap-fit manner to said one of the side members and said one of the end members of the bed base wherein the upper piece of the corner assembly includes a first flexible tab which snaps into an opening in one of the side members of the bed base and a second flexible tab which snaps into an opening in one of the end members of the bed base.

2. The bed base of claim 1, wherein each of the pieces of each of the corner assemblies is plastic.

3. The bed base of claim 1, wherein the upper piece of the corner assembly includes two projections which snap into openings in the lower piece of the corner assembly.

4. A pedestal bed base comprising:

two side members;

two end members;

four corner assemblies, each of the corner assemblies connecting one of the side members and one of the end members and comprising an upper piece and a lower piece snap-fit together without the use of any tools or fasteners, at least one of the pieces of the corner assembly being secured in a snap-fit manner to said one of the side members and said one of the end members of the bed base, wherein the lower piece of the corner assembly includes a first projection which fits into an opening in the one of the end members of the bed base and a second projection which fits into an opening in the one of the side members of the bed base.

5. The bed base of claim 1, wherein the upper piece of the corner assembly includes a first stop which abuts a side edge of one of the side members of the bed base.

6. The bed base of claim 1, wherein the top wall of one of the side members and one of the end members of the bed base has a cutout for receiving a vertically oriented lip of the upper piece of the corner assembly.

7. A pedestal bed base comprising:

two side members;

two end members;

four corner assemblies, each of the corner assemblies connecting one of the side members and one of the end members, wherein each of the corner assemblies comprises an upper piece and a lower piece secured together in a snap-fit manner without a need for any tools or fasteners, a portion of one of the side members and a portion of one of the end members of the bed base being sandwiched between the upper and lower pieces of the corner assembly, wherein the lower piece of the corner assembly includes a first projection which fits into an opening in one of the side members of the bed base and a second projection which fits into an opening in one of the end members of the bed base.

8. The bed base of claim 7, wherein each of the pieces of each of the corner assemblies is plastic.

9. The bed base of claim 7, wherein the upper piece of the corner assembly includes two projections which snap into openings in the lower piece of the corner assembly.

10. A pedestal bed base comprising:

two side members;

two end members;

four corner assemblies, each of the corner assemblies connecting one of the side members and one of the end members, wherein each of the corner assemblies comprises an upper piece and a lower piece secured together in a snap-fit manner without a need for any tools or fasteners, a portion of one of the side members and a portion of one of the end members of the bed base being sandwiched between the upper and lower pieces of the corner assembly, wherein the upper piece of the corner assembly includes a first flexible tab which snaps into an opening in one of the side members of the bed base and a second flexible tab which snaps into an opening in one of the one of the end members of the bed base.

11. The bed base of claim 7, wherein the lower piece of the corner assembly includes a first projection which fits into an opening in one of the side members of the bed base and a second projection which fits into an opening in one of the end members of the bed base.

12. The bed base of claim 7, wherein the upper piece of the corner assembly includes a first stop which abuts a side edge of one of the side members of the bed base.

13. The bed base of claim 7, wherein a top wall of one of the side members of the bed base and a top wall of one of the end members of the bed base each has a cutout for receiving a vertically oriented lip of the upper piece of the corner assembly.

14. A method of assembling a pedestal bed base, the method comprising:

snapping one of two side members of the pedestal bed base into engagement with an upper piece of a corner assembly;

snapping one of two end members of the pedestal bed base into engagement with the upper piece of the corner assembly; and snapping a lower piece of the corner assembly into engagement with the upper piece of the corner assembly such that a first projection of the lower piece of the corner assembly fits into an opening in the one of the end members of the bed base and a second projection of the lower piece of the corner assembly fits into an opening in the one of the side members of the bed base, wherein the step of snapping one of two side members of the pedestal bed base into engagement with an upper piece of a corner assembly comprises engaging a flexible tab with an opening in the one of two side members of the pedestal bed base.

15. A method of assembling a pedestal bed base, the method comprising:

snapping one of two side members of the pedestal bed base into engagement with an upper piece of a corner assembly;

snapping one of two end members of the pedestal bed base into engagement with the upper piece of the corner assembly; and snapping a lower piece of the corner assembly into engagement with the upper piece of the corner assembly such that a first projection of the lower piece of the corner assembly fits into an opening in the one of the end members of the bed base and a second projection of the lower piece of the corner assembly fits into an opening in the one of the side members of the bed base, wherein the step of snapping one of two end members of the pedestal bed base into engagement with an upper piece of a corner assembly comprises engaging a flexible tab with an opening in the one of two end members of the pedestal bed base.

16. The method of claim 14, wherein the step of snapping the lower piece of the corner assembly into engagement with the upper piece of the corner assembly comprises passing two projections of the upper piece of the corner assembly into openings in the lower piece of the corner assembly.

17. The method of claim 14, wherein the step of snapping one of two side members of the pedestal bed base into engagement with an upper piece of a corner assembly further comprises abutting an edge of the one of two side members of the pedestal bed base against a stop of the upper piece of the corner assembly.

18. The method of claim 15, wherein the step of snapping one of two end members of the pedestal bed base into engagement with an upper piece of a corner assembly further comprises abutting an edge of the one of two end members of the pedestal bed base against a stop of the upper piece of the corner assembly.

* * * * *